US005512192A

United States Patent [19]

Lange et al.

[11] Patent Number: 5,512,192

[45] Date of Patent: Apr. 30, 1996

[54] DISPERSANT-VISCOSITY IMPROVERS FOR LUBRICATING OIL COMPOSITIONS

[75] Inventors: Richard M. Lange, Euclid; Carmen V. Luciani, Wickliffe, both of Ohio

[73] Assignee: The Lubrizol Corporation, Wickliffe, Ohio

[21] Appl. No.: 490,378

[22] Filed: Jun. 14, 1995

Related U.S. Application Data

[63] Continuation of Ser. No. 398,195, Mar. 2, 1995, abandoned.

[51] Int. Cl.[6] ..... C10M 145/00

[52] U.S. Cl. ..... 252/51.5 A; 575/64; 575/92 F; 575/381; 575/382

[58] Field of Search ..... 252/51.5 A; 525/64, 525/92 F, 381, 382

[56] References Cited

U.S. PATENT DOCUMENTS

| | | | |
|---|---|---|---|
| 4,077,893 | 3/1978 | Kiovsky | 252/56 R |
| 4,169,063 | 9/1979 | Kiovsky | 252/51.5 A |
| 4,517,104 | 5/1985 | Bloch et al. | 252/51.5 A |
| 4,632,769 | 12/1986 | Gutierrez et al. | 252/48.6 |
| 4,670,173 | 6/1987 | Hagashi et al. | 252/51.5 A |
| 4,803,003 | 2/1989 | Chung | 252/51.5 A |
| 5,035,821 | 7/1991 | Chung et al. | 252/51.5 A |
| 5,049,294 | 9/1991 | Van Zon et al. | 252/51.5 A |
| 5,073,600 | 12/1991 | Gorman et al. | 525/264 |
| 5,210,146 | 5/1993 | Gutierrez et al. | 252/301 |

FOREIGN PATENT DOCUMENTS 0352070 10/1992 European Pat. Off. ..... C10M 143/02

OTHER PUBLICATIONS

Ranney, M. W., "Lubricant Additives", Noyes Data Corp. (1973) pp. 119–136, month unknown.

Ranney, M. W., "Lubricant Additives, Recent Developments", Noyes Data Corp. (1978), pp. 151–159, month unknown.

Ranney, M. W., "Synthetic Oils and Additives for Lubricants, Advances Since 1977", Noyes Data Corp. (1980), pp. 119–150, month unknown.

*Primary Examiner*—Prince Willis, Jr.
*Assistant Examiner*—Cephia D. Toomer
*Attorney, Agent, or Firm*—Joseph P. Fischer; Frederick D. Hunter; James L. Cordek

[57] ABSTRACT

A composition of matter suitable for use as a dispersant-viscosity improver for lubricating oil compositions comprises the reaction product of reactants comprising (a) an oil soluble, substantially hydrogenated, vinyl substituted aromatic-aliphatic conjugated diene block copolymer said copolymer having a number average molecular weight ranging from about 30,000 to about 300,000, grafted with an ethylenically unsaturated carboxylic acid or functional derivative thereof;

(b-1) at least one polyester containing at least one condensable hydroxyl group; and (b-2) at least one polyamine having at least one condensable primary or secondary amino group, and optionally, (c) at least one hydrocarbyl substituted carboxylic acid or anhydride.

46 Claims, No Drawings

DISPERSANT-VISCOSITY IMPROVERS FOR LUBRICATING OIL COMPOSITIONS

This is a continuation of application Ser. No. 08/398,195 filed on Mar. 2, 1995, now abandoned.

FIELD OF THE INVENTION

This invention relates to dispersant-viscosity improvers for lubricating oils, and oil compositions and concentrates containing such dispersant-viscosity improvers.

BACKGROUND OF THE INVENTION

The viscosity of lubricating oils, particularly the viscosity of mineral oil based lubricating oils, is generally dependent upon temperature. As the temperature of the oil is increased, the viscosity usually decreases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Viscosity improvers are usually polymeric materials and are often referred to as viscosity index improvers.

Dispersants are also well-known in the lubricating art. Dispersants are employed in lubricants to keep impurities, particularly those formed during operation of mechanical devices such as internal combustion engines, automatic transmissions, etc. in suspension rather than allowing them to deposit as sludge or other deposits on the surfaces of lubricated parts..

Multifunctional additives that provide both viscosity improving properties and dispersant properties are likewise known in the art. Such products are described in numerous publications including Dieter Klamann, "Lubricants and Related Products", Verlag Chemie Gmbh (1984), pp 185–193; C. V. Smalheer and R. K. Smith "Lubricant Additives", Lezius-Hiles Co. (1967); M. W. Ranney, "Lubricant Additives", Noyes Data Corp. (1973), pp 92–145, M. W. Ranney, "Lubricant Additives, Recent Developments", Noyes Data Corp. (1978), pp 139–164; and M. W. Ranney, "Synthetic Oils and Additives for Lubricants", Noyes Data Corp. (1980), pp 96–166. Each of these publications is hereby expressly incorporated herein by reference.

Dispersant-viscosity improvers are generally prepared by functionalizing, i.e., adding polar groups, to a hydrocarbon polymer backbone.

Hayashi, et al, U.S. Pat. No. 4,670,173 relates to compositions suitable for use as dispersant-viscosity improvers made by reacting an acylating reaction product which is formed by reacting a hydrogenated block copolymer and an alpha-beta olefinically unsaturated reagent in the presence of free-radical initiators, then reacting the acylating product with a primary amine and optionally with a polyamine and a mono-functional acid.

Chung et al, U.S. Pat. No. 5,035,821 relates to viscosity index improver-dispersants comprised of the reaction products of an ethylene copolymer grafted with ethylenically unsaturated carboxylic acid moieties, a polyamine having two or more primary amino groups or polyol and a high functionality long chain hydrocarbyl substituted dicarboxylic acid or anhydride.

Van Zon et al, U.S. Pat. No. 5,049,294, relates to dispersant/VI improvers produced by reacting an a alpha-beta unsaturated carboxylic acid with a selectively hydrogenated star-shaped polymer then reacting the product so formed with a long chain alkane-substituted carboxylic acid and with a $C_1$ to $C_{18}$ amine containing 1 to 8 nitrogen atoms and/or with an alkane polyol having at least two hydroxy groups or with the performed product thereof.

Bloch et al, U.S. Pat. No. 4,517,104, relates to oil soluble viscosity improving ethylene copolymers reacted or grafted with ethylenically unsaturated carboxylic acid moieties then with polyamines having two or more primary amine groups and a carboxylic acid component or the preformed reaction product thereof.

Gutierrez et al, U.S. Pat. No. 4,632,769, describes oil-soluble viscosity improving ethylene copolymers reacted or grafted with ethylenically unsaturated carboxylic acid moieties and reacted with polyamines having two or more primary amine groups and a $C_{22}$ to $C_{28}$ olefin carboxylic acid component.

Each of these patents is hereby expressly incorporated herein by reference.

For additional disclosures concerning multi-purpose additives and particularly viscosity improvers and dispersants, the disclosures of the following U.S. patents are incorporated herein by reference:

| | | |
|---|---|---|
| 2,973,344 | 3,488,049 | 3,799,877 |
| 3,278,550 | 3,513,095 | 3,842,010 |
| 3,311,558 | 3,563,960 | 3,864,098 |
| 3,312,619 | 3,598,738 | 3,864,268 |
| 3,326,804 | 3,615,288 | 3,879,304 |
| 3,403,011 | 3,637,610 | 4,033,889 |
| 3,404,091 | 3,652,239 | 4,051,048 |
| 3,445,389 | 3,687,849 | 4,234,435 |

It is a primary object of this invention to provide novel multi-purpose lubricant additives.

It is a particular object to provide lubricant additives having a novel molecular microstructure.

A more specific object is to provide multi-purpose additives directed to improving lubricant viscosities and dispersancy properties.

A further object is to provide processes for preparing such multi-purpose additives.

Another object is to provide a composition having viscosity-improving characteristics which composition has compatibility with hydrotreated mineral oils and polyalpha-olefin oils which is improved compared to vinyl substituted aromatic-conjugated diene copolymers.

Still another object is to provide lubricants having improved dispersancy and viscosity properties.

Other objects will in part be obvious in view of this disclosure and will in part appear hereinafter.

SUMMARY OF THE INVENTION

According to the present invention a composition of matter suitable for use as a dispersant-viscosity improver for lubricating oil compositions comprises the reaction product of reactants comprising (a) an oil soluble, substantially hydrogenated, vinyl substituted aromatic-aliphatic conjugated diene block copolymer said copolymer having a number average molecular weight ranging from about 30,000 to about 300,000, grafted with an ethylenically unsaturated carboxylic acid or functional derivative thereof;

(b-1) at least one polyester containing at least one condensable hydroxyl group; and (b-2) at least one polyamine having at least one condensable primary or secondary amino group, and optionally, (c) at least one hydrocarbyl substituted carboxylic acid or anhydride.

DESCRIPTION OF THE PREFERRED EMBODIMENTS

The Oil Soluble, Substantially Hydrogenated, Vinyl Substituted Aromatic-Aliphatic Conjugated Diene Copolymer As used herein, the term copolymer refers to interpolymers derived from 2 or more monomers. In the present invention one of the monomers is a vinyl substituted aromatic compound and the other is an aliphatic conjugated diene.

The vinyl substituted aromatics generally contain from 8 to about 20 carbons, preferably from 8 to 12 carbon atoms and most preferably, 8 or 9 carbon atoms.

Examples of vinyl substituted aromatics include vinyl anthracenes, vinyl naphthalenes and vinyl benzenes (styrenes). Styrenes are preferred. Example of styrenes include styrene, alpha-methystyrene, ortho-methyl styrene, meta-methyl styrene. para-methyl styrene, para-tertiary-butylstyrene, with styrene being preferred.

The conjugated dienes generally have from 4 to about 10 carbon atoms and preferably from 4 to 6 carbon atoms. Example of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The vinyl substituted aromatic content of these copolymers is typically in the range of about 20% to about 70% by weight, preferably about 40% to about 60% by weight. The aliphatic conjugated diene content of these copolymers is typically in the range of about 30% to about 80% by weight, preferably about 40% to about 60% by weight.

The copolymers can be prepared by methods well known in the art. Such copolymers usually are prepared by anionic polymerization using Group Ia metals in the presence of electron-acceptor aromatics, or preformed organometallics such as sec-butyllithium as polymerization catalysts.

The styrene/diene block polymers of this invention are usually made by anionic polymerization, using a variety of techniques, and altering reaction conditions to produce the most desirable features in the resulting polymer. In an anionic polymerization, the initiator can be either an organometallic material such as an alkyl lithium, or the anion formed by electron transfer from a Group IA metal to an aromatic material such as naphthalene. A preferred organometallic material is an alkyl lithium such as sec-butyl lithium; the polymerization is initiated by addition of the butyl anion to either the diene monomer or to the styrene.

When an alkyl lithium initiator is used, a homopolymer of one monomer, e.g., styrene, can be selectively prepared, with each polymer molecule having an anionic terminus, and lithium gegenion. The carbanionic terminus remains an active initiation site toward additional monomers.

$$Bu^{-}\,{}^{+}Li + mA\ (\text{monomer}) \rightarrow Bu\text{-}(\text{-}A\text{-})_m^{-}\,{}^{+}Li$$

The resulting polymers, when monomer is completely depleted, will usually all be of similar molecular weight and composition, and the polymer product will be "monodisperse" (i.e., the ratio of weight average molecular weight to number average molecular weight is very nearly 1.0) At this point, addition of 1,3-butadiene, isoprene or other suitable anionically polymerizable monomer to the homopolystyrene-lithium "living" polymer produces a second segment which grows from the terminal anion site to produce a living di-block polymer having an anionic terminus, with lithium gegenion.

$$Bu\text{-}(\text{-}A\text{-})_m^{-}\,{}^{+}Li + nB\ (\text{monomer}) \rightarrow Bu\text{-}(\text{-}A\text{-})_m\text{-}(\text{-}B\text{-})_n^{-}\,{}^{+}Li$$

Subsequent introduction of additional styrene can produce a new poly A-block-poly B-block-poly A, or A-B-A triblock polymer; higher orders of block polymers can be made by consecutive stepwise additions of different monomers in different sequences.

Alternatively, a living diblock polymer can be coupled by exposure to an agent such as a dialkyl-dichlorosilane. When the carbanionic "heads" of two A-B diblock living polymers are coupled using such an agent, precipitation of LiCl occurs to give an A-B-A triblock polymer of somewhat different structure than that obtained by the sequential monomer addition method described above, wherein the size of the central B block is double that of the B block in the starting living (anionic) diblock intermediate.

Block copolymers made by consecutive addition of styrene to give a relatively large homopolymer segment (A), followed by a diene to give a relatively large homopolymer segment (B), are referred to as poly-A-block-poly-B copolymers, or A-B diblock polymers.

In another variation, where metal naphthalide is used to initiate polymerization, single electron-transfer to monomer (A) generates a radical-anion which can dimerize to yield a di-anionic nucleophile which in turn initiates polymerization in two directions simultaneously. Thus, $$\bullet Naph^{-}Li^{+} + A\ (\text{monomer}) \longrightarrow Naph + \bullet A^{-}Li^{+}$$

$$2\,\bullet A^{-}Li^{+} \longrightarrow (\text{dianion})$$

$${}^{+}Li^{-}A - A^{-}Li^{+} + mA\ (\text{monomer}) \longrightarrow$$

$${}^{+}Li^{-}(-A-)_{m+2}-Li^{+}$$

Exposure to a second monomer (B) results in formation of a polyB-block-polyA-block-polyB, or a B-A-B triblock polymeric dianion, which may continue to interact with additional anionically-polymerizable monomers of the same, or different chemical type, in the formation of higher order block polymers. Ordinary block copolymers are generally considered to have up to about 5 such blocks.

The solvent employed in anionic polymerization can determine the nature of the copolymer that is formed. Non-polar paraffinic solvents such as hexane or heptane inhibit charge separation at the growing anion, diminish the basicity of the active organolithium head, and slow the rates of initiation, thus emphasizing the differences in relative rate of polymerization between various monomers.

Usually, one monomer or another in a mixture will polymerize faster, leading to a segment that is richer in that monomer, contaminated by occasional incorporation of the other monomer. In some cases, this can be used beneficially to build a type of polymer referred to as a "random block polymer", or "tapered block polymer. When a mixture of two different monomers is anionically polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a more or less "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, in a "tapered block copolymer."

An alternative way of preparing random or tapered block copolymers involves initiation of styrene, and interrupting with periodic, or step, additions of diene monomer. The additions are programmed according to the relative reactivity ratios and rate constants of the styrene and particular diene monomer.

"Promoters" are electron-rich molecules that facilitate anionic initiation and polymerization rates while lessening the relative differences in rates between various monomers. Promoters also influence the way in which diene monomers are incorporated into the block polymer, favoring 1,2-polymerization of dienes over the normal 1,4-cis-addition, which can affect the solubility properties of the resulting polymer. Promoters include tetrahydrofuran, tetrahydropyran, linear and crown ethers, N,N-dimethylformamide, tetramethyl ethylenediamine, and other non-protic agents that have non-bonding electron pairs available for coordination.

Hydrogenation of the unsaturated block polymers initially obtained produces polymers that are more oxidatively and thermally stable. Reduction is typically carried out as part of the polymerization process, using finely divided, or supported, nickel catalyst. Other transition metals may also be used to effect the transformation. Hydrogenation is normally carried out to reduce approximately 94–96% of the olefinic unsaturation of the initial polymer. In general, it is preferred that these copolymers, for reasons of oxidative stability, contain no more than about 5% and more preferably no more than about 0.5% residual olefinic unsaturation on the basis of the total amount of olefinic double bonds present in the polymer prior to hydrogenation. Such unsaturation can be measured by a number of means well known to those of skill in the art, such as infrared or nuclear magnetic resonance spectroscopy. Most preferably, these copolymers contain no significant unsaturation, as determined by the aforementioned-mentioned analytical techniques.

Other polymerization techniques such as emulsion polymerization can be used.

The polymers, and in particular, styrene-diene copolymers, can be random copolymers, regular block copolymers or random block copolymers. Random copolymers are those in which the comonomers are randomly, or nearly randomly, arranged in the polymer chain with no significant blocking of homopolymer of either monomer. Regular block copolymers are those in which a small number of relatively long chains of homopolymer of one type of monomer are alternately joined to a small number of relatively long chains of homopolymer of another type of monomer. Random block copolymers are those in which a large number of relatively shorter chains of homopolymer of one type of monomer alternate with relatively shorter chains of homopolymer of another monomer type.

The random, regular block and random block polymers used in this invention may be linear, or they may be partially or highly branched. The relative arrangement of homopolymer segments in a linear regular block or random block polymer is obvious. Differences in structure lie in the number and relative sizes of the homopolymer segments; the arrangement in a linear block polymer of either type is always alternating in homopolymer segments.

Normal or regular block copolymers usually have from 1 to about 5, often 1 to about 3, preferably only from 1 to about 2 relatively large homopolymer blocks of each monomer. Thus, a linear regular diblock copolymer of styrene or other vinyl aromatic monomer (A) and diene (B) would have a general structure represented by a large block of homopolymer (A) attached to a large block of homopolymer (B), as:

$$(A)_a\ (B)_b$$

where a and b are as described hereinbelow. One illustration is

AAAAAAAAAAAAAAA—BBBBBBBBBBBBBB

Block A Block B wherein the blocks of monomer (A) and monomer (B) are not necessarily the same size or molecular weight.

Similarly, a regular linear tri-block copolymer of styrene or other vinyl aromatic monomer (A) and diene monomer (B) may be represented by the structures:

AAAAAAAAAAA-BBBBBBBBBBBBBB-AAAAAAAAAA, or

BBBBBBBBBB-AAAAAAAAAAAAAAAA-BBBBBBBB.

Techniques vary for the preparation of these "A-B-A" and "B-A-B" triblock polymers, and are described in the literature for anionic polymerization.

As in the case of linear A-B diblock polymers, the sizes of the A and B blocks are not necessarily the same, but may vary considerably. The only stipulation is that any regular block copolymer comprises relatively few, but relatively large, alternating homopolymer segments.

A third monomer (C) may also be incorporated into these linear, regular block copolymers. Several configurations are possible depending on how the homopolymer segments are arranged with respect to each other. For example, linear triblock copolymers of monomers (A), (B) and (C) can be represented by the general configurations:

(A)a-(B)b-(C)c, (A)a-(C)c-(B)b, or (B)b-(A)a-(C)c, wherein the lower case letters a, b and c represent the approximate number of monomer units in the indicated block.

As an example applicable to the instant invention, when (A) represents blocks derived from diene such as isoprene or butadiene, "a" usually ranges from about 100 to about 2000, preferable from about 500 to about 1500; when (B) represents, for example, blocks derived from styrene, "b" usually ranges from about 100 to about 2000, preferably from about 200 to about 1000; and when a third block (C) is present, "c" usually ranges from about 10 to about 1000, provided that the $M_n$ of the polymer is within the ranges indicated as useful for this invention.

Often the arrangement of the various homopolymer blocks is dictated by the reaction conditions such as catalyst and polymerization characteristics of the monomers employed. Conditions for modifying arrangement of polymer blocks are well known to those of skill in the polymer art. Literature references relating to polymerization techniques and methods for preparing certain types of block polymers include:

1) "Encyclopedia of Polymer Science and Engineering", Wiley-Interscience Publishing, New York, ( 1986);

2) A. Noshay and J. E. McGrath, "Block Copolymers", Academic Press, New York, (1977);

3) R. J. Ceresa, ed., "Block and Graft Copolymerization", John Wiley and Sons, New York, (1976); and 4) D. J. Meier, ed., (Block Copolymers", MMI Press, Harwood Academic Publishers, New York, (1979).

Each of these is hereby icorporated herein by reference for relevant disclosures relating to block copolymers.

In practice, in a linear normal block copolymer, the number of repeat monomer units involved in each polymer block usually exceeds about 500, but it can be less than about 500. The sequence length in one block should be long enough so that the block copolymer exhibits about the same inherent homopolymeric physical properties such as glass transition temperature and polymer melt temperature as a normal homopolymer of the particular monomer.

Examples of suitable normal diblock copolymers as set forth above include Shellvis-40, and Shellvis-50, both hydrogenated styrene-isoprene block copolymers, manufactured by Shell Chemical.

Random block copolymers which can be utilized separately, in combination with the normal block copolymers set forth above, or not at all, are generally defined as a block copolymer having one or more block polymer portions therein. More specifically, the random block copolymers can be defined as having an indeterminate number of A and B blocks of indeterminate lengths. These random block copolymers are generally made from one monomer of the conjugated diene type noted above and hereby incorporated by reference with butadiene or isoprene being preferred. The remaining monomer utilized to make the random block copolymer comprises vinyl substituted aromatics of the type set forth hereinabove and are also hereby fully incorporated by reference. A suitable type of aromatic monomer is styrene. The random block copolymer can be made by simultaneously, or intermittantly, feeding a mixture of monomers to a polymerization system rather than by feeding the monomers in a sequential manner. The amount of the various blocks by weight may be the same as set forth above, that is from about 20 to about 70 percent by weight of vinyl substituted aromatic blocks with 40 to 60 percent by weight of such blocks being preferred. The number average molecular weight and the weight average molecular weight of the random block copolymers may be essentially the same as set forth above and accordingly are hereby fully incorporated by reference. The random block copolymers contain a significant number of blocks of a vinyl substituted aromatic repeating unit and a significant number of blocks of a conjugated diene repeating unit arranged in an alternating manner. These copolymers also can be represented as by A'-B'-A'-B'- wherein A' is a block of vinyl substituted aromatic compound, B' is a block of conjugated diene, and the lengths of A' and B' blocks vary widely and, are substantially shorter than the A and B blocks of a normal block polymer. The amount of the aromatic a block content of the random block copolymer preferably should be in the range of about 15 to about 45, more preferably 25 to about 40 weight percent.

A special type of configuration of linear random block copolymers is the tapered block structure. In this arrangement a major portion of the polymer backbone is of the random block type, with larger blocks of one type of homopolymer situated at one end of the molecule. Synthesis of this type of polymer may be carried out by preparing a linear random block polymer, then adding more of one of the monomer types near the end of the polymerization so that the additional polymer forms a series of ever larger homopolymer blocks at the end of the growing linear polymer chain. The vinyl substituted aromatic monomer is usually chosen to provide the larger, tapered homopolymer blocks, although either type of monomer may be used for this purpose.

Linear random tapered block copolymers may have significantly different solubilities in diluents normally used in lubricant formulations, different thickening power at high temperature, different high temperature viscosity under conditions of high shear, and improved low temperature viscometrics compared to random block copolymers of similar molecular weight made from the same monomers.

Examples of such commercially available random block copolymers include the various Glissoviscal block copolymers manufactured by BASF. A previously available random block copolymer was Phil-Ad viscosity improver, manufactured by Phillips Petroleum.

Regardless of whether a true or normal block copolymer or a random block copolymer, or combinations of both are utilized, they are hydrogenated before use in this invention so as to remove virtually all of their olefinic double bonds. Techniques for accomplishing this hydrogenation are well known to those of skill in the art and need not be described in detail at this point. Briefly, hydrogenation is accomplished by contacting the copolymers with hydrogen at superatmospheric pressures in the presence of a metal catalyst such as colloidal nickel, palladium supported on charcoal, etc.

In general, it is preferred that these copolymers, contain no more than about 5% and preferably no more than about 0.5% residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the aforementioned analytical techniques. Aromatic unsaturation is not considered to be olefinic unsaturation within the context of this invention.

The copolymers typically have number average molecular weights ($M_n$) in the range of about 30,000 to about 300,000, preferably from about 30,000 to about 150,000. The weight average molecular weight for these copolymers is generally in the range of about 50,000 to about 500,000, preferably from about 50,000 to about 300,000.

The Ethylenically Unsaturated Carboxylic Acid or Functional Derivative Thereof The ethylenically unsaturated carboxylic acids or functional derivatives are well know in the art; they include such acids as acrylic acid, methacrylic acid, maleic acid, fumaric acid, crotonic acid, citraconic acid, itaconic acid and mesaconic acid, as well as their anhydrides, amides or imides, and esters (especially the lower alkyl esters, the term "lower alkyl" meaning alkyl groups having up to 7 carbon atoms). The preferred compounds are the alpha-beta-olefinic carboxylic acids, especially those containing at least two carboxy groups and more especially dicarboxylic acids, and their derivatives. Maleic acid and maleic anhydride, especially the latter, are particularly preferred.

Reactant (a) is prepared by grafting, either by mastication of the neat polymer, or in solution, the ethylenically unsaturated carboxylic acid or functional derivative onto the ethylene copolymer backbone employing techniques that are well-known in the art. Free-radical grafting techniques are usually employed. Thermal grafting by the "ene" reaction using copolymers containing unsaturated sites, such as ethylene-propylene-diene copolymers may be employed.

The ethylenically unsaturated carboxylic acid is generally employed in amounts ranging from about 0.01% to 10% preferably 0.1–5%, more preferably 0.2–2% by weight, based on the weight of polymer.

Free Radical Generating Reagents

The radical grafting is preferably carried out using free radical initiators such as peroxides, hydroperoxides, and azo compounds which decompose thermally within the grafting temperature range to provide said free radicals.

Free radical generating reagents are well known to those skilled in the art. Examples include benzoyl peroxide, t-butyl perbenzoate, t-butyl metachloroperbenzoate, t-butyl peroxide, sec-butylperoxydicarbonate, azobisisobutyronitrile, and the like. Numerous examples of free radical generating reagents, also known as free radical initiators, are mentioned in the above-referenced tests by Flory and by Bovey and Winslow. An extensive listing of free radical initiators appears in J. Brandrup and E. H. Immergut, Editor, "Polymer Handbook", 2nd edition, John Wiley and Sons, New York (1975), pages II-1 to II-40. Preferred free radical generating reagents include t-butyl peroxide, t-butyl hydroperoxide, t-amyl peroxide, cumyl peroxide, t-butyl peroctoate, t-butyl-m-chloroperbenzoate and azobisisovaleronitrile.

The free radical initiators are generally used in an amount from 0.01 to about 10 percent by weight based on the total weight of the reactants. Preferably, the initiators are used at about 0.05 to about 1 percent by weight.

The reaction is usually conducted at temperatures ranging between about 80° C. to about 200° C., preferably between about 130° C. to about 170° C. Considerations for determining reaction temperatures include reactivity of the system and the half-life of the initiator at a particular temperature.

The choice of free radical generating reagent can be an important consideration. For example, when a polymer undergoing grafting with a monomer is diluted with a solvent such as a hydrocarbon oil, grafting of the monomer onto the oil diluent may occur. It has been observed that the choice of initiator affects the extent of grafting of the monomer onto the oil diluent. Reducing the amount of monomer grafted onto the diluent usually results in an increased amount of monomer grafted onto the polymer backbone. Improved efficiency of monomer grafting onto olefinic copolymer resins has been described in U.S. Pat. No. 5,298,565 which is hereby incorporated herein by reference for relevant disclosures in this regard.

Azo group containing initiators, such as Vazo® polymerization initiators (DuPont) employed in the grafting process at about 95° C. result in a much higher degree of grafting onto the polymer backbone than do peroxide initiators such as t-butyl peroxide, employed at about 150°–160° C. Peresters are particularly effective in the free-radical grafting process.

(b-1) The Hydroxy-Containing Polyester

The use of the hydroxy-containing polyester b-1) in preparing the composition of this invention is unique. The hydroxy-containing polyesters are carboxylic compounds which contain at least one condensable hydroxyl group. As defined herein, condensable refers to the group's availability for further reaction with for example, an acylating agent. The polyester (b-1) may be prepared by reacting a hydrocarbyl-substituted polycarboxylic acid or functional derivative thereof, such as an anhydride, with a polyol, or a mixture of polyols wherein the polyol is present in amounts such that the number of hydroxyl groups thereon exceeds the number required to react with all of the available carboxyl groups. Subsequent condensation is usually carried out at high temperatures with removal of volatiles. Thus, the resulting product is a polyester containing unreacted hydroxyl groups. The unreacted hydroxyl groups are available to be condensed with acylating reactants polymeric (a) and monomeric (c).

The polycarboxylic acid employed to prepare the polyesters (b-1) may be illustrated by the general formula $$R—(COOH)_n$$

wherein R is a hydrocarbyl group. R may be aliphatic or aromatic, including alkyl, alkenyl, aralkyl and alkaryl, including mixtures of acids containing aliphatic and aromatic groups. Preferably R is an aliphatic group, and preferably contains from about 5 to about 500 carbon atoms, more preferably from 16 to about 200 carbon atoms, even more preferably from about 30 to about 100 carbon atoms. The subscript 'n' is a number ranging from 2 to about 10, preferably 2 to about 4, more preferably 2 or 3. In an especially preferred embodiment n=2. Mixtures of such acids are also useful and are contemplated for use in preparing the hydroxy containing polyesters used in this invention.

Mixtures of two or more polycarboxylic acids may be used, often imparting desirable performance characteristics to the hydroxy-containing polyester intermediate and the compositions of this invention.

Suitable polycarboxylic acids or anhydrides are hydrocarbyl substituted, preferably oil-soluble. Preferably the hydrocarbyl substituent is aliphatic and contains at least 8 carbon atoms, more preferably at least about 30 carbon atoms. In another embodiment the polycarboxylic acid or anhydride comprises a mixture of hydrocarbyl substituted polycarboxylic acids or anhydrides, especially a mixture comprising aliphatic substituted polycarboxylic acids or anhydrides containing from about 12 to about 24 carbon atoms in the aliphatic substituent and aliphatic substituted polycarboxylic acids or anhydrides having at least about 40 carbon atoms in the aliphatic substituent.

Patents describing useful aliphatic polycarboxylic acids or anhydrides and methods for preparing them include, among numerous others, U.S. Pat. Nos. 3,215,707 (Rense); 3,219,666 (Norman et al), 3,231,587 (Rense); 3,912,764 (Palmer); 4,110,349 (Cohen); and 4,234,435 (Meinhardt et al); and U.K. 1,440,219 which are hereby incorporated by reference for their disclosure of useful carboxylic reactants.

The polyalkenes from which the carboxylic acids reactants may be derived are homopolymers and interpolymers, also referred to herein as copolymers, of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)", or "copolymers" as used herein is inclusive of polymers derived from two different monomers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C=C<); that is, they are monolefinic monomers such as ethylene, propylene, 1-butene, isobutene, and 1-octene or polyolefinic monomers (usually diolefinic monomers) such as 1,3-butadiene and isoprene.

These olefin monomers are usually polymerizable terminal olefins; that is, olefins characterized by the presence in their structure of the group $>C{=}CH_2$. However, polymerizable internal olefin monomers (sometimes referred to in the literature as medial olefins) characterized by the presence within their structure of the group

—C—C=C—C— also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

Preferred polycarboxylic acids include polyolefin substituted succinic acids, succinic anhydrides, ester acids or lactone acids.

Numerous polycarboxylic acids are commercially available, many from more than one source. The commercially available polycarboxylic acids can be used in the preparation of polyester intermediates used in this invention. While these commercially available polyacids, or their esters may be used by themselves, it is usually beneficial to employ them in combination with polyolefin substituted succinic acids, anhydrides or functional derivatives thereof. Such commercially available polycarboxylic acids and anhydrides include, but are not limited to aliphatic acids such as glutaric, adipic, pimelic, sebacic, azaleic, suberic, dodecanedioic, 5-norbornenedicarboxylic, bicyclooctenedicarboxylic, 2-OH-succinic, citric, tartaric, cyclopentanetetracarboxylic, 5-norbornene-2,3-dicarboxylic, cyclohexene-4, 5-dicarboxylic and cyclohexanedicarboxylic (1,2-1,3-, and 1,4-). Also useful are aromatic acids and anhydrides such as phthalic, isophthalic, terephthalic, trimellitic anhydride, trimesic, pyromellitic, 2,3- and 2,6-naphthalenedicarboxylic, 2,6-naphthalenedicarboxylic, 1,8-naphthalic, benzophenonetetracarboxylic, and 1,1,3-trimethyl-3-phenylindane-4',5'-dicarboxylic.

Polyacids from vegetable- and animal-sourced carboxylic compounds can be used for preparing polyesters of this invention. Dimer acids, made by the thermal coupling of unsaturated vegetable acids, are available from Emery, Westvaco, Unichema and other companies. Polyacid reaction products of unsaturated vegetable acids with acrylic acid and maleic anhydride are available from Westvaco under the product names Diacid 1550 and Tenax 2010, respectively. Another useful vegetable derived acid is 12-hydroxystearic acid, which can provide both carboxyl and hydroxy functionality to the polyester.

Additionally, polyether alpha,omega-acids, such as 3,6,9-trioxaundecane-1,11-dioic acid and mixed polyglycol diacids available from Hoechst Chemie can also be incorporated into the hydroxy-containing polyesters to impart surface activity and polarity, and to affect morphology at low temperatures.

The carboxylic acids used to make the hydroxy-containing polyesters used in this invention may also comprise up to about 20 equivalent % of the carboxylic acid functionality as monocarboxylic acid, that is, acids where n=1. Such mixtures of acids preferably contain no more than about 10 equivalent % as monocarboxylic acid, more preferably, no more than about 5 equivalent %. Most preferred is where the polycarboxylic acid used to prepare the polyesters used in this invention is essentially free of monocarboxylic acids, that is containing no more than a minor, impurity amount, of monocarboxylic acid.

Monocarboxylic acids which may be present in a mixture with polycarboxylic acids have the formula $R^3COOH$. $R^3$ is a hydrocarbyl group, preferably an aliphatic group. Preferably, $R^3$ contains from about 2 to about 500 carbon atoms. In one preferred embodiment, $R^3$ is an aliphatic group containing from about 8 to about 24 carbon atoms, more often from about 12 to about 18 carbon atoms. Examples of such acids are caprylic, capric, palmitic, stearic, isostearic, oleic, linoleic, and behenic acids.

Another preferred group of monocarboxylic acids is prepared by the reaction of a polyolefin or a halogenated olefin polymer with acrylic acid or methacrylic acid.

Such polyolefins or olefin oligomers or polymers typically contain from about 12 to about 200 carbon atoms, preferably from about 18, frequently from about 30, up to about 100 carbon atoms. The polyolefin or olefin polymers may be obtained by polymerization of a variety of monoolefins, preferably, alpha olefins, containing from 2 to about 12 carbon atoms, more preferably 3 to 8 carbons, ever more preferably 3 to 4 carbon atoms.

Suitable dicarboxylic acids include the substituted succinic acids having the formula $$R^4-\begin{array}{c}|\\ CHCOOH\\ |\\ CH_2COOH\end{array}$$

wherein $R^4$ is the same as R and $R^3$ as defined above. $R^4$ is preferably an olefin polymer-derived group formed by polymerization of such monomers as ethylene, propylene, 1-butene, isobutene, 1-pentene, 2-pentene, 1-hexene and 3-hexene. Such groups usually contain from about 30 to about 200, more often up to about 100 carbon atoms. $R^4$ may also be derived from a high molecular weight substantially saturated petroleum fraction. The hydrocarbon-substituted succinic acids and their derivatives constitute the most preferred class of carboxylic acids.

Polycarboxylic acids containing from 3 to 10 carbon atoms are also useful for preparing the polyesters employed in this invention. It is often useful to employ these lower polycarboxylic acids in combination with higher molecular weight polycarboxylic acids when making the intermediate hydroxy-containing polyesters.

The above-described classes of carboxylic acids derived from olefin polymers, and their derivatives, are well known in the art, and methods for their preparation as well as representative examples of the types useful in the present invention are described in detail in the following U.S. patents:

| | | |
|---|---|---|
| 3,172,892 | 3,316,771 | 3,522,179 |
| 3,216,936 | 3,373,111 | 3,542,678 |
| 3,219,666 | 3,381,022 | 3,542,680 |
| 3,271,310 | 3,341,542 | 3,579,450 |
| 3,272,746 | 3,344,170 | 3,632,510 |

-continued

| | | |
|---|---|---|
| 3,278,550 | 3,448,048 | 3,632,511 |
| 3,281,428 | 3,454,607 | 3,639,242 |
| 3,306,908 | 3,515,669 | |

Non-limiting examples of compounds useful as polycarboxylic reactants for reaction with polyols to prepare the polyester of this invention include those in the following examples. Parts in the following examples are, unless otherwise indicated, parts by weight. Temperatures are in degrees Celsius (°C.).

EXAMPLE b-1

A mixture of 6400 parts (4 moles) of a polybutene comprising predominantly isobutene units and having a number average molecular weight of about 1600 and 408 parts (4.16 moles) of maleic anhydride is heated at 225°–240° C. for 4 hours. It is then cooled to 170° C. and an additional 102 parts (1.04 moles) of maleic anhydride is added, followed by 70 parts (0.99 mole) of chlorine; the latter is added over 3 hours at 170°–215° C. The mixture is heated for an additional 3 hours at 215° C. then vacuum stripped at 220° C. and filtered through diatomaceous earth. The product is the desired polybutenyl-substituted succinic anhydride having a saponification number of 61.8.

EXAMPLE b-2

A polybutenyl succinic anhydride is prepared by the reaction of a chlorinated polybutylene with maleic anhydride at 200° C. The polybutenyl radical has a number average molecular weight of 805 and contains primarily isobutene units. The resulting alkenyl succinic anhydride is found to have an acid number of 113 (corresponding to an equivalent weight of 500).

EXAMPLE b-3

A lactone acid is prepared by reacting 2 equivalents of a polyolefin (Mn about 900) substituted succinic anhydride with 1.02 equivalents of water at a temperature of about 90° C. in the presence of a catalytic amount of concentrated sulfuric acid. Following completion of the reaction, the sulfuric acid catalyst is neutralized with sodium carbonate and the reaction mixture is filtered.

EXAMPLE b-4

An ester acid is prepared by reacting 2 equivalents of an alkyl substituted succinic anhydride having an average of about 35 carbon atoms in the alkyl group with 1 mole of ethanol.

EXAMPLE b-5

A reactor is charged with 1000 parts of polybutene having a number average molecular weight determined by vapor phase osmometry of about 950 and which consists primarily of isobutene units, followed by the addition of 108 parts of maleic anhydride. The mixture is heated to 110° C. followed by the sub-surface addition of 100 parts $Cl_2$ over 6.5 hours at a temperature ranging from 110° to 188° C. The exothermic reaction is controlled as not to exceed 188° C. The batch is blown with nitrogen then stored.

EXAMPLE b-6

A procedure similar to that of Example b-5 is repeated employing 1000 parts of polybutene having a molecular weight determined by vapor phase osmometry of about 1650 and consisting primarily of isobutene units and 106 parts maleic anhydride. $Cl_2$ is added beginning at 130° C. and added at a nearly continuous rate such that the maximum temperature of 188° C. is reached near the end of chlorination. The residue is blown with nitrogen and collected.

EXAMPLE b-7

A reactor is charged with 1000 parts of $C_{18-24}$ olefin mixture obtained from Albamarle Corporation, Houston, Tex. The material is heated to 65° followed by addition of 350 parts maleic anhydride. The temperature is increased to 213° then held at reflux until the total acid number is between 285–295. The reactor contents are stripped to remove volatile materials until analysis shows % maleic acid is less than 0.30%.

EXAMPLE b-8

A reactor is charged with 1000 parts of a polybutene having a number average molecular weight of about 1500 and 47.9 parts molten maleic anhydride. The materials are heated to 138° C. followed by chlorination, allowing the temperature to rise to between 188°–191° C., heating and chlorinating until the acid number is between 43 and 49 (about 40–45 parts $Cl_2$ are utilized). The materials are heated at 224°–227° C. for about 2.5 hours until the acid number stabilizes. The reaction product is diluted with 438 parts mineral oil diluent and filtered with a diatomaceous earth filter aid.

The polyhydric alcohols useful in the preparation of the polyester esters may contain up to about 8 hydroxyl groups, and may be linear or branched. The expressions "branched" or "linear" refer to the configuration of the hydrocarbon backbone of the polyhydric alcohol. The polyhydric alcohol will generally contain from two to about 28 carbons. For example, glycerol, containing 3 hydroxy groups is linear and pentaerythritol, with four hydroxyl groups, is branched. Neopentylene glycol, with 2 hydroxyl groups, is branched.

Specific examples of polyhydroxy compounds useful in the present invention include ethylene glycol, diethylene glycol, triethylene glycol, propylene glycol, dipropylene glycol, glycerol, 1,2- and 1-3, propanediol neopentylene glycol, 1,2-, 1-3-, and 1,4-butanediols, 1,4-butenediols, pentaerythritol, dipentaerythritol, tripentaerythritol, triglycerol, trimethylolpropane, sorbitol, hexaglycerol, 2,2,4-trimethyl-1,3-pentanediol, etc. Mixtures of any of the above polyhydroxy compounds can be utilized. Preferred polyhydric alcohols are ethylene glycol, neopentylene glycol, glycerol and pentaerythritol. Diols usually result in essentially linear polyesters, whereas triols and higher polyhydric alcohols may result in the formation of branched polyesters. Also, tri- and higher polyhydric alcohols can provide polyesters containing hydroxyl groups. Pentaerythritol is an especially preferred polyhydric alcohol for preparing the polyesters used in this invention.

The polyhydric alcohols used in the preparation of the polyesters also may include polyethers or partial fatty acid esters of polyols or polyether polyols. Useful polyethers include polyoxyalkene diols, such as diethylene glycol and higher oligo(ethylene oxides), alkoxylated glycerol, ethoxylated trimethyolpropane, etc. Partial fatty acid esters useful as polyhydric alcohols will contain at least two free hydroxyl groups. Glycerol monooleate is illustrative of a polyol partial ester.

The polyhydroxy compounds used in the preparation of the hydroxy containing polycarboxylic polyesters also may contain one or more nitrogen atoms. For example, the polyhydroxy compound may be an alkanol amine containing from 2 to 6 hydroxy groups. In one preferred embodiment, the polyhydroxy compound is a tertiary alkanol amine containing at least two hydroxy groups and more preferably at least three hydroxy groups. Illustrative of such aminopolyols are diethanolamine, triethanolamine, and alkoxylated $C_4$–$C_{18}$ primary alkyl amines marketed by Pegwalt and Akzo Chemie, the latter under the tradenames Propomeen and Ethomeen.

The carboxylic esters are prepared by reacting at least one carboxylic acid with at least one polyhydroxy compound containing at least two hydroxy groups. The formation of esters by the interaction of carboxylic acids and alcohols is usually acid catalyzed and is a reversible process which can be made to proceed to completion by use of a large amount of alcohol or by removal of water as it is formed in the reaction. However, esterification can be accomplished by non-catalyzed processes, driven to completion by exhaustive dehydration. If the ester is formed by transesterification of a lower molecular weight carboxylic ester, the reaction can be forced to completion by removal of the low molecular weight alcohol formed as a result of a transesterification reaction. The esterification reaction can be catalyzed by either organic acids or inorganic acids. Examples of inorganic acids include sulfuric acids and acidified clays. A variety of organic acids can be utilized including paratoluenesulfonic acid, acidic resins such as Amberlyst 15, etc. Organometallic catalysts include, for example, tetraisopropyl orthotitanate and dibutyltin diacetate.

The amounts of carboxylic acids and polyhydroxy compounds included in the reaction mixture may be varied depending on the results desired. However, sufficient polyhydroxy compound must be present to provide a polyester containing at least one free hydroxyl group per average polyester molecule. When mixtures of acids are reacted with a polyhydroxy compound in accordance with the present invention, the carboxylic acids can be reacted sequentially with the polyhydroxy compounds or a mixture of carboxylic acids can be prepared and the mixture reacted with the polyhydroxy compounds.

Throughout the specification and claims, it should be understood that the polyesters also can be formed by reaction of the polyhydroxy compound with the anhydrides of any of the above-described polycarboxylic acids.

However, it is to be further understood that the acid reactants must be capable of generating a polyester. Accordingly, the acidic reactants will always contain at least 80% of the carboxylic functionality as polyacids capable of forming polyesters. Thus, for example, while monocarboxylic acids may be present in the carboxylic acids used to prepare the polyesters they may be only a minor component of the mixture of acidic reactants, at least 80% being polycarboxylic acids capable of forming polyesters with the polyol reactants.

The formation of polyesters by the reaction of carboxylic acids or anhydrides with the polyhydroxy compounds described above can be effected by heating the acids or anhydrides, the polyhydroxy compounds, and a catalyst if used, to an elevated temperature while removing water or low molecular weight alcohols formed in the reaction. Generally, temperatures of from about 175° C. to about 200° C. or higher are sufficient for the reaction.

The following examples illustrate polyesters (b-1) and processes for preparing polyesters.

EXAMPLE (b-1)-1

A substantially hydrocarbon-substituted succinic anhydride is prepared by chlorinating a polybutene having a number average molecular weight of 1000 to a chlorine content of 4.5% and then heating the chlorinated polybutene with 1.2 molar proportions of maleic anhydride at a temperature of 150°–220° C. A mixture of 874 grams (2 carbonyl equivalents) of this succinic anhydride and 104 grams (1 mole) of neopentylene glycol is maintained at 240°–250° C./30 mm for 12 hours. The residue is a mixture of hydroxy containing polyester resulting from the esterification of one and both hydroxy groups of the glycol. Typical analyses are acid number of 10, a number average molecular weight of 5500 and an average of one free condensable —OH per polyester molecular weight.

EXAMPLE (b-1)-2

A mixture of 3225 parts (5.0 carbonyl equivalents) of the polybutene-substituted succinic acylating agent prepared in Example (b-1)-1 and 289 parts (8.5 equivalents based on —OH) of pentaerythritol is heated at 224°–235° C. for 5.5 hours, with removal of volatiles by nitrogen blowing. Then 5204 parts mineral oil are added followed by mixing. The homogeneous mixture is filtered at 130° C. to yield an oil solution of the desired polyester product.

EXAMPLE (b-1)-3

A mixture of 1000 parts of polybutene having a number average molecular weight of about 1000 and 108 parts ( 1.1 moles) of maleic anhydride is heated to about 190° C. and 100 parts (1.43 moles) of chlorine are added beneath the surface over a period of about 4 hours while maintaining the temperature at about 185°–190° C. The mixture is then blown with nitrogen at this temperature for several hours, and the residue is the desired polybutenyl-substituted succinic acylating agent.

A solution of 1000 parts of the above-prepared acylating agent is heated to about 150° C. with stirring, and 109 parts (3.2 equivalents) of pentaerythritol are added with stirring. The mixture is blown with nitrogen and heated to about 220° C. over a period of about 14 hours. The batch is then mixed with 872 parts of mineral oil and filtered using a diatomaceous earth filter aid. The filtrate is an oil solution of the desired carboxylic polyester typically having a number average molecular weight of about 5179.

EXAMPLE (b-1)-4

A reactor is charged with 1000 parts of a polybutenyl-substituted succinic acylating agent prepared as in Example (b-1)-3. At between 160°–175° C. are added 121 parts of pentaerythritol. The materials are heated to 200° C. over 8 hours followed by nitrogen blowing at 204°–210° C. for 8 hours. Water is removed and is collected. Upon completion of the reaction, the materials are diluted with 872 parts of mineral oil and the solution is filtered with a diatomaceous earth filter aid. Typical analyses are acid number=8. The polyester contains about 1.8 —OH groups per repeating unit.

EXAMPLE (b-1)-5

Following essentially the procedure of Example (b-1)-1, a tetrapropenyl-substituted acylating agent is prepared and converted to a pentaerythritol polyester.

EXAMPLE (b-1)-6

A reactor charged with 1000 parts of the $C_{18-24}$ substituted succinic anhydride of Example b-7 and 289 parts of pentaerythritol is heated to 200° C. and is held at 200° C. to 235° C. for 5 hours, removing volatiles by $N_2$ blowing. The materials are diluted with 800 parts of mineral oil and filtered.

EXAMPLE (b-1)-7

A reactor is charged with 1000 parts of The product of Example b-6 and 464 parts of mineral oil. The materials are heated to 140° C. under $N_2$, 110 parts pentaerythritol are added and the materials are heated to 210° C. over 6 hours while removing water employing a sub-surface $N_2$ sparge. At this point 750 parts oil are added and the batch is cooled to 150° C. and filtered.

The carboxylic polyester derivatives which are described above resulting from the reaction of an acylating agent with a polyhydroxy-containing compound such as polyol or aminopolyol may be further reacted with any of the hereinafter described amines, and particularly polyamines.

These polycarboxylic acid derivative compositions are known in the art, and the preparation of a number of these derivatives is described in, for example, U.S. Pat. Nos. 3,957,854 and 4,234,435 which are hereby expressly incorporated herein by reference. The following examples illustrate the preparation of the esters wherein an alkanolamine or both an alcohol and an amine are reacted with the acylating agent.

EXAMPLE (b-1)-8

A reactor is charged with 1000 parts of a polybutenyl-substituted succinic anhydride prepared essentially as described in Example (b-1)-3, 109 parts pentaerythritol and 31 parts Polyglycol® 112-3, a polyether polyol obtained by reacting glycerol, propylene oxide and ethylene oxide, having a molecular weight ranging from about 4600 to about 5300. The mixture is heated to 210° C. over 6 hours employing a sub-surface $N_2$ sparge. The materials are cooled to 160° C. and a toluene solution of 19 parts of commercial ethylene polyamine having a % N of about 34 is added over 1 hours followed by heating and $N_2$ sparging at 160° C. for 3 hours. The product is diluted with 800 parts mineral oil and filtered using a diatomaceous earth filter aid.

EXAMPLE (b-1)-9

To the polyester of example (b-1)-3 are added 857 parts of mineral oil and 19.25 parts (0.46 equivalent) of a commercial mixture of ethylene polyamines having an average of about 3 to 10 nitrogen atoms per molecule. The reaction mixture is further stripped of volatiles by heating at 205° C. with nitrogen blowing for 3 hours and filtered. The filtrate is an oil solution (45% 100 neutral mineral oil) of the desired amine-modified carboxylic polyester of about 2850 number average molecular weight which contains 0.35% nitrogen, total base number of 2 and total acid number of 4.

EXAMPLE (b-1)-10

A reactor equipped with a stirrer, condenser with Dean-Stork trap, thermocouple probe and $N_2$ inlet ($N_2$ at 0.5 standard cubic feet/hour (SCFH)) is charged with 1100 parts of a polybutenyl substituted succinic anhydride prepared according to the procedure of Example (b-1)-3, 146 parts triethanolamine and 125 parts toluene. The mixture is heated to 210° over 4 hours then stirring and heating is continued at tiffs temperature for 26 hours, collecting a clear yellow distillate having pH 7–9 in the Dean-Stark trap. $N_2$ flow is increased to 1.5 SCFH and stirring is continued at temperature for 3 additional hours, cool to 105°, and charge 800 parts mineral oil. The materials are stirred at temperature for 0.5 hour, mixed with a diatomaceous earth filter aid and filtered. The filtrate contains, by analysis, 0.69% N and 0.18% —OH. Total acid no.=1.83; total base no.=22.9.

EXAMPLE (b-1)-11

A reactor is charged with 1000 parts of the polyester of Example (b-1)-7 and heated to 150° C. A solution of 15 parts of a commercial polyamine having about 34% nitrogen and total base number of 41 in 15 parts toluene is added over 0.5 hour. The materials are stirred for 2 hours at 160° C. with $N_2$ sparging, 550 parts mineral oil is added and the solution is filtered.

Other discussions and illustrations of suitable procedures are provided, for example, in LeSuer, U.S. Pat. No. 3,381,022 and U.S. Pat. No. 3,522,179 and Meinhardt et al, U.S. Pat. No. 4,234,435.

(b-2) The polyamine

The polyamine (b-2) contains at least two basic nitrogen atoms and is characterized by the presence within its structure of at least one HN< group. Mixtures of two or more amino compounds can be used in the reaction. Preferably, the polyamine contains at least one primary amino group (i.e., —$NH_2$) and more preferably is a polyamine containing at least two condensable —NH— groups, either or both of which are primary or secondary amine groups. The amines may be aliphatic, cycloaliphatic, aromatic or heterocyclic amines. The polyamines not only result in carboxylic acid derivative compositions which are usually more effective as dispersant/detergent additives, relative to derivative compositions derived from monoamines, but polyamines result in carboxylic derivative compositions which exhibit more pronounced viscosity improving properties.

Among the preferred amines are the alkylene polyamines, including the polyalkylene polyamines. The alkylene polyamines include those conforming to the formula $$R^2N-(U-\underset{\underset{R^2}{|}}{N})_n-R^2$$

wherein n is from 1 to about 10; each $R^2$ is independently a hydrogen atom, a hydrocarbyl group or a hydroxy-substituted or amine-substituted hydrocarbyl group having up to about 30 atoms, or two $R^2$ groups on different nitrogen atoms can be joined together to form a U group, with the proviso that at least one $R^2$ group is a hydrogen atom and U is an alkylene group of about 2 to 10 carbon atoms. Preferably U is ethylene or propylene. Especially preferred are the alkylene polyamines where each $R^2$ is hydrogen or an amino-substituted hydrocarbyl group with the ethylene polyamines and mixtures of ethylene polyamines being the most preferred. Usually n will have an average value of from 2 to about 7. Such alkylene polyamines include methylene polyamine, ethylene polyamines, butylene polyamines, propylene polyamines, pentylene polyamines, hexylene polyamines, heptylene polyamines, era. The higher homologues of such amines and related amino alkyl-substituted piperazines are also included.

Alkylene polyamines useful in preparing the compositions of this invention include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologues as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7 pages 27–39, Interscience Publishers, Division of John Wiley and Sons, 1965, and in Meinhardt et al, U.S. Pat. No. 4,234,435, both of which are hereby incorporated by reference for the disclosure of useful polyamines. Such compounds are prepared most conveniently by the reaction of an alkylene dichloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher linear and branched analogs of diethylenetriamine, triethylenetetramine and the like.

In another embodiment, the polyamine may be a hydroxyamine provided that the polyamine contains at least one condensable —N—H group. Typically, the hydroxyamines are primary or secondary alkanol amines or mixtures thereof. Such amines can be represented by mono- and poly-N-hydroxyalkyl substituted alkylene polyamines wherein the alkylene polyamines are as described hereinabove; especially those that contain two to three carbon atoms in the alkylene radicals and the alkylene polyamine contains up to seven amino groups.

In one embodiment, the polyamine (b-2) is the reaction product of any of the aforementioned polyamines with a carboxylic acid or anhydride wherein the resulting product contains at least one condensable N—H group. Such a material may be obtained by employing an excess of amine reactant relative to the carboxylic reactant.

Suitable polyamines of this type include, but are not limited to the reaction product of mono- and poly- carboxylic acids and functional derivatives thereof, such as anhydrides, with at least one polyamine, preferably an alkylene polyamine as defined hereinabove, containing at least two condensable —N—H groups provided that the resulting product contains at least one condensable N—H group. Exemplary of the patent literature relating to such materials are U.S. Pat. Nos. 3,172,892; 3,219,666; 4,234,435 each of which is expressly incorporated herein by reference, and numerous others.

In a further embodiment, the reaction product of amine and carboxylic reactant may be borated by treatment with a borating agent such as boric acid, boric anhydride and the like. Preferred borating agents are inorganic and boric acid is especially preferred.

The reaction product of amine and carboxylic reactant itself may be reacted with a wide variety of other reactants. Exemplary reagents include carbon disulfide, $H_2S$, boron containing reagents such as boric acid, boron anhydride, boron esters, and the like, sulfur, sulfur chloride, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde producing compounds plus phenols.

Examples of reaction products useful as component b-2 include:

EXAMPLE (b-2)-1

A reaction flask is charged with 698 parts of mineral oil and 108 parts of a commercial polyethylene polyamine mixture having typical % N=34. The materials are stirred and heated to 135° C. at which time 1000 parts of a polybutene substituted succinic anhydride prepared according to the procedure of Example b-1 are added over 1 hour. With $N_2$ sparging, the temperature is increased to 160° C. and held there for 4 hours while removing water and other volatile components. The product is filtered using a diatomaceous earth filter aid yielding a filtrate typically containing 2% N and a total base number of 45.

EXAMPLE (b-2)-2

The procedure of example (b-2)-1 is repeated except that before filtration, the materials are reacted with 28 parts of terephthalic acid at 160° for three hours. The product has typical analyses of 1.9% N and a total base number=35.

EXAMPLE (b-2)-3

The procedure of Example (b-2)-1 is repeated except that before filtration the materials are reacted with 21 parts $CS_2$ to give a sulfur and nitrogen containing condensate.

EXAMPLE (b-2)-4

A polybutene having a number average molecular weight=1350 (1000 parts) is reacted with 106 parts maleic anhydride with $Cl_2$ blowing (total $Cl_2$ about 90 parts). To a reactor containing 1000 parts of the substituted succinic anhydride is added 1050 parts mineral oil, the materials are heated, with mixing, to 120° C., followed by addition of 70 parts of the commercial amine mixture described in Example (b-2)-1. The reaction mixture is heated to 155° C. over 4 hours with $N_2$ sparging to remove volatiles then filtered employing a diatomaceous earth filter aid. The filtrate typically contains, by analysis, 1.1% N and has a total base number=20.

EXAMPLE (b-2)-5

An acylated polyamino is prepared by reacting 1000 parts of polyisobutenyl ($M_n$ 1000) substituted succinic anhydride with 85 parts of a commercial ethylene polyamine mixture having an average nitrogen content of about 34.5% in 820 parts mineral oil diluent under conditions described in LeSuer U.S. Pat. No. 3,172,892.

EXAMPLE (b-2)-6

A boron containing composition is prepared by reacting a mixture of 275 parts mineral oil, 147 parts of a commercial ethyleneamine mixture having an average composition corresponding to that of tetraethylenepentamine and 1000 parts of polyisobutene ($M_n \approx 1000$) substituted succinic anhydride at 120°–125° C. for 2 hours and at 150° C. for 2 hours then blown with nitrogen at 150° C. for 5 hours to form an acylated amine. To a slurry of 239 parts boric acid in 398 parts mineral oil there is added 1405 parts of above acylated amine over a period of 2 hours. The mixture is heated to 150° C. for 7 hours and filtered employing a diatomaceous earth filter aid to give a liquid product typically containing, by analysis, 1.9% B and 2.3% N.

EXAMPLE (b-2)-7

A solution of 698 parts mineral oil and 108 parts commercial ethylene polyamine mixture containing an average of about 34% nitrogen is prepared and heated to 115° C. To the oil solution is added 1000 parts of the polybutenyl-substituted succinic anhydride of Example (b-1)-3 under $N_2$ followed by heating to 150° C. The reaction is continued at 143°–150° C. for 1 hour. The product is then filtered.

EXAMPLE (b-2)-8

The procedure of Example (b-2)-4 is repeated except the polybutenyl group on the substituted succinic anhydride is derived from a polyisobutene having a number average molecular weight, measured by vapor phase osmometry, Of about 1700.

(c) The Hydrocarbyl Substituted Carboxylic Acid or Anhydride.

Optionally, the compositions of this invention are prepared employing an additional reactant (c), a carboxylic acid or anhydride. Suitable carboxylic acids or anhydrides are hydrocarbyl substituted, preferably oil-soluble. These may be aromatic, cycloaliphatic and aliphatic acids. Preferably the hydrocarbyl substituent is aliphatic and contains at least 8 carbon atoms, more preferably at least about 30 carbon atoms. In another embodiment (c) comprises a mixture of hydrocarbyl substituted carboxylic acids or anhydrides wherein the mixture comprises aliphatic substituted carboxylic acids or anhydrides containing from about 12 to about 24 carbon atoms in the aliphatic substituent and aliphatic substituted carboxylic acids or anhydrides having at least about 40 carbon atoms in the aliphatic substituent.

Suitable carboxylic acids and anhydrides include those described hereinabove with reference to the polyester (b-1).

Patents describing useful aliphatic carboxylic acids or anhydrides and methods for preparing them include, among numerous others, U.S. Pat. Nos. 3,215,707 (Rense); 3,219,666 (Norman et al), 3,231,587 (Rense); 3,912,764 (Palmer); 4,110,349 (Cohen); and 4,234,435 (Meinhardt et al); and U.K. 1,440,219. These patents are hereby incorporated herein by reference for relevant disclosures contained therein.

As indicated in the above-mentioned patents, which are hereby incorporated by reference for their disclosure of compounds useful as component (c) of this invention, the carboxylic acids (or various derivatives thereof) include those derived by the reaction of an alpha, beta-unsaturated carboxylic acid containing compound with a polyalkene or halogenated derivative thereof or a suitable olefin.

The polyalkenes from which the carboxylic acids (c) may be derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C=C<); that is, they are monolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group >C=CH2. However, polymerizable internal olefin monomers (sometimes referred to in the literature as medial olefins) characterized by the presence within their structure of the group

—C—C=C—C— also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

Preferred carboxylic acids include polyolefin substituted succinic acids, succinic anhydrides, ester acids or lactone acids.

In another preferred embodiment, the acid or anhydride (c) may contain from about 8 to 28 carbon atoms. When these are aliphatic acids, preferably predominantly linear acids, they tend to provide friction reducing characteristics to lubricating oils comprising the dispersant-viscosity improvers of this invention which incorporate such acids therein.

Particularly useful acids are hydrocarbyloxypolyalkyleneoxycarboxylic acids. Some examples of the hydrocarbyloxypolyalkyleneoxycarboxylic acids include: isostearyl-O—$(CH_2CH_2O)_5CH_2CO_2$; lauryl-O—$(CH_2CH_2O)_{2.5}$—$CH_2$ $CO_2H$; lauryl-O—$(CH_2CH_2O)_{3.3}CH_2CO_2H$; oleyl-O—$(CH_2CH_2O)_4$—$CH_2CO_2H$; lauryl-O—$(CH_2CH_2O)_{4.5}CH_2CO_2H$; lauryl-O—$(C_3H_6O)_x(CH_2CH_2O)_yCH_2CO_2H$, wherein x=2–3 and y=1–2, lauryl-O—$(CH_2CH_2O)_{10}$—$CH_2CO_2H$ lauryl-O$(CH_2CH_2O)_{16}$—$CH_2CO_2H$; octylphenyl-O—$(CH_2CH_2O)_8CH_2CO_2H$; octylphenyl-O—$(CH_2CH_2O)_{19}CH_2$—$CO_2H$; and 2-octadecanyl-O—$(CH_2CH_2O)_6$ $CH_2$ $CO_2H$. In one embodiment, the hydrocarbyloxypolyalkyleneoxycarboxylic acid is stearyl pentaethyleneglycolacetic acid, preferably it is isostearylpentaethyleneglycolacetic acid. Some of these acids are available commercially from Sandoz Chemical under the tradename Sandopan Acids.

Other similar polyoxyalkylene carboxylic acids that have methoxy terminal groups, such as 3,6,9-trioxa-decanoic acid are marketed by Hoechst Chemie.

Other acids useful as (c) are aromatic acids such as benzoic, salicylic, hydroxynaphthoic and heterocyclic acids, for example, pyridine dicarboxylic acid.

As discussed hereinabove, the compositions of the present invention are prepared by reacting (a) an acylated ethylene-alpha olefin copolymer with (b-1) a polyester and (b-2) a polyamine and optionally (c) a hydrocarbyl substituted carboxylic acid or anhydride.

The acylated copolymer (a) and hydroxy-containing polyester (b-1) are reacted in ratios ranging from about 1 C═O in (a) to about 1 OH in the polyester (b-1) up to about 1 C═O from (a) to about 20 OH from (b-1), preferably 1 C═O to about 5 OH up to about 1 C═O to about 10 OH. In another embodiment, (a) and (b-1) are reacted in amounts ranging from about 4–16 OH per C═O, more often from about 8–14 OH per C═O.

It is recognized that it is unlikely that 100% of the C═O will react with the OH-containing polyester. The remaining acid functionality, e.g., from acid or anhydride, etc., is available to react with the polyamine (b-2). Preferably, the polyamine is present in amounts sufficient to react with at least about 50% of the unreacted acid functionality, more often at least about 75% of the acid functionality. Large excesses of polyamine are desirably avoided in order to reduce attack on ester groups from the polyester or the acylated resin-hydroxy-containing polyester.

Reactant (c) may be employed to react with remaining OH groups or N—H groups that have not reacted with C═O from (a).

The reactions are generally conducted at elevated temperatures, usually at temperatures ranging from about 100° C. to about 300° C. or even higher, but below the decomposition temperature of any of the reactants or products. Typical temperatures are those given in the following examples.

Compositions of this invention may be prepared by reacting the reactants in a variety of ways. For example (c) may be first reacted with one of (b-1) and (b-2) before reaction with (a). In another embodiment, (c) is reacted with the product formed by reacting (a), (b-1) and (b-2) or may be reacted simultaneously with (a), (b-1) and (b-2). In a further embodiment, (b-2) is first reacted with (a) and the product so obtained is then reacted with (b-1). Alternatively, (b-1) may be first reacted with (a) before reaction with (b-2), or (b-1) may be reacted with (b-2) before reaction with (a).

The following examples are intended to illustrate several compositions of this invention as well as means for preparing same.

EXAMPLE 1

Part A

A reactor equipped with a stirrer, condenser, $N_2$ inlet, thermometer, addition funnel and Dean-Stark trap is charged with 4320 parts of 100 Neutral (100N) mineral oil and 480 part of a commercial hydrogenated styrene-isoprene diblock copolymer having a number average molecular weight (Mn)=155,000 (Shellvis 40, Shell Chemical) and heated to 140° C. under $N_2$ with stirring and held at 140° C. for 4 hours to obtain a homogeneous solution. To the solution are added 14.4 parts maleic anhydride followed by heating to 160° C. Over 1 hour, 14.4 parts tertiary butyl peroxide are added dropwise then held at 160° C. for 1.5 hour, all under $N_2$ blanket. The temperature is increased to 165° C. and is $N_2$ blown at 1 SCFH for 2 hours. To the residue are added 1200 parts diphenyl alkane (Vista Chemical) followed by stirring at 120° for 1 hour. Total acid number of solution is 2.5 determined using $NaOCH_3$/thymol blue indicator.

Part B

To the reactor containing 6000 parts of the product of Part A, above, are added 3000 parts of the product of Example (b-1)-3 followed by heating to 150° C. with $N_2$ sparging followed by the dropwise addition over 0.2 hour of 48 parts of a commercial ethylene polyamine mixture (E-100, Dow) while $N_2$ sparging at 0.25 SCFH followed by heating at 150°–155° C. for 3 hours, removing water as distillate. $N_2$ is 0.5 SCFH during last hour of heating. The product is filtered employing a cartridge filter. Filtrate contains, by analysis, 0.18% N.

EXAMPLE 2

Part A

The procedure of EXAMPLE 1. Part A is repeated employing 600 parts of polymer, 5400 parts mineral oil, 30 parts each maleic anhydride and tertiary butyl peroxide and 1500 parts diphenyl alkane. Acid number is 4.4.

Part B

Following the procedure of EXAMPLE 1. Part B, a solution is prepared by mixing 3750 parts of the polyester of Example (b-1)-3 and 7500 parts of the product of Part A, above. A solution prepared from 54 parts of polyamine (E-100) and 100 parts toluene is added subsurface over 0.5 hour with $N_2$ at 0.25 SCFH. The materials are heated at 150°–155° C. for 2.5 hours removing water and toluene. $N_2$ is increased to 1 SCFH during last hour of heating. The product is filtered using a cartridge filter yielding a product containing, by analysis, 0.16% N.

EXAMPLE 3

A reactor is charged with 1000 parts of the product of EXAMPLE 2-A, heated under $N_2$ sparge at 0.5 SCFH to 100° C. wherein 628 parts of the product of Example (b-1)-3 are added followed by 8.0 parts of polyamine (E-100). The materials are heated, with stirring, to 150° C. over 0.5 hour then heating is continued at 150°–155° C. for 2 hours while removing aqueous distillate. The product contains, by analysis, 0.18% N.

EXAMPLE 4

A reactor is charged with 1000 parts of the product of EXAMPLE 2-A and 300 parts of the product of Example (b-1)-3 then is heated to 90° C. A mixture of 11.1 parts polyamine (E-100) and 200 parts of the product of Example (b-1)-3 is prepared followed by thickening of the mixture.

The mixture is fluidized with 50 parts toluene at 50°. This toluene solution is added dropwise to the reactor over 0.5 hour at 95°–100° C., the temperature is maintained for 0.5 hour then is increased to 150° C. Heating is continued for 2.5 hours at 150°–155° C. with $N_2$ at 0.25 SCFH, removing aqueous distillate. The materials are stripped to 150° C. at 15 mm Hg pressure. The residue is filtered with a diatomaceous earth filter aid. The filtrate contains, by analysis, 0.32% N.

EXAMPLE 5

A reactor is charged with 1000 parts of the product of EXAMPLE 2-A and 500 parts of the product of Example (b-1)-3 then heated to 150° C. with $N_2$ at 0.25 SCFH. A solution of 11.1 parts polyamines (E-100) in 50 parts toluene is added dropwise over 0.5 hour while temperature decreases to 145° C. Temperature is increased to 150° C. and heating is continued at 150°–155° C. for 2.5 hours while removing aqueous distillate. The materials are stripped to 150° C. at 13 mm Hg and filtered with a diatomaceous earth filter aid. Filtrate contains, by analysis, 0.25% N.

EXAMPLE 6

The procedure of EXAMPLE 5 is repeated except the polyamines are added undiluted over about 1–2 minutes. The materials are filtered through cloth filter. Filtrate contains, by analysis, 0.24% N.

EXAMPLE 7

The procedure of EXAMPLE 5 is repeated except 7.1 parts polyamine (E-100) are used. The product contains, by analysis, 0.18% N.

EXAMPLE 8

A reactor is charged with 1000 parts of the product of EXAMPLE 2-A and 250 parts of the polyester of Example (b-1)-3. The charge is heated to 130° C. and held at the temperature for 0.75 hour followed by increasing temperature to 155° C. Over 0.25 hour, 250 parts of the product of Example (b-2)-4 are added, $N_2$ at 0.25 SCFH. The materials are heated at 155°–157° C. for 3 hours. Product contains, by analysis, 0.23% N.

EXAMPLE 9

A reactor is charged with 1000 parts of the product of EXAMPLE 2-A and 300 parts of the product of Example (b-1)-3 followed by heating to 150° C., $N_2$ purge at 0.25 SCFH. A solution of 8.5 parts polyamine (E-100) in 50 parts toluene is added over 0.5 hour and the reaction is heated at 150°–155° C. for 2.5 hour while maintaining $N_2$ and removing distillate. The materials are stripped to 155° at 15 mm Hg pressure then diluted with 198 parts diphenyl alkane (Vista). The solution is filtered through cloth. The filtrate contains, by analysis, 0.23% N.

EXAMPLE 10

The procedure of EXAMPLE 9 is repeated employing 200 parts of the product of Example (b-1)-3, 4.3 parts polyamine and 305 parts diphenylamine. Product contains, by analysis, 0.12% N.

EXAMPLE 11

The procedure of EXAMPLE 10 is repeated employing 6.8 parts of polyamine. Product contains, by analysis, 0.21% N.

EXAMPLE 12

The procedure of EXAMPLE 9 is repeated employing 5.4 parts polyamine and 205 parts diphenylalkane. Product contains, by analysis, 0.14% N.

EXAMPLE 13

The procedure of EXAMPLE 9 is repeated employing 2000 parts of a product as in EXAMPLE 2-A having a total acid number=3, 700 parts of the product of Example (b-1)-3, 10 parts polyamine and 200 parts diphenyl amine. Product contains, by analysis, 0.12% N.

EXAMPLE 14

A reactor is charged with 250 parts of the product of EXAMPLE 2-A which is heated to 140° C. with $N_2$ sparge at 0.25 SCFH followed by addition of 80 parts of the product of Example (b-1)-3. The temperature is increased to 150° C. over 0.25 hour, 2 parts tetraethylene pentamine are added, the temperature is increased to 155° C. and is held there for 2 hours. The product contains, by analysis, 0.20% N.

EXAMPLE 15

A reactor is charged with 300 parts of the product of EXAMPLE 1-A, 75 parts of the reaction product of Example (b-2)-7 and 50 parts of the product of Example (b-1)-3. The materials are heated for 2 hours at 150° C.

EXAMPLE 16

A reactor is charged with 394 parts of a product prepared by reacting at 150° C. for 2 hours 390 parts of the reaction product of EXAMPLE 1-A and 138 parts of the product of Example (b-2)-5, and 98 parts of the product of Example (b-1)-. The materials are heated at 150° C. for 2 hours the cooled and filtered at 95° C. through diatomaceous earth filter aid.

The Oil of Lubricating Viscosity

The lubricating compositions and methods of this invention employ an oil of lubricating viscosity, including natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins, etc, and mixtures thereof, alkylbenzenes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyether polyols.

Other synthetic lubricating oils include liquid esters of phosphorus-containing acids, polymeric tetrahydrofurans, alkylated diphenyloxides and the like.

Hydrotreated naphthenic oils are well known.

Many viscosity improvers, and particularly functionalized dispersant viscosity improvers such as acylated polyolefins reacted with amines or alcohols are not readily compatible with certain types of oils of lubricating viscosity, notably polyolefin oils and hydrotreated oils. The dispersant viscosity improvers of this invention display outstanding compatibility with these oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin III, U.S. Pat. No. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

Other Additives

As mentioned, the compositions of this invention may contain minor amounts of other components. The use of such additives is optional and the presence thereof in the compositions of this invention will depend on the particular use and level of performance required. The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and antioxidancy performance.

In addition to zinc salts of dithiophosphoric acids discussed hereinabove, other additives that may optionally be used in the lubricating oils of this invention include, for example, detergents, dispersants, viscosity improvers, oxidation inhibiting agents, metal passivating agents, pour point depressing agents, extreme pressure agents, anti-wear agents, color stabilizers and anti-foam agents. The above-mentioned dispersants and viscosity improvers are used in addition to the additives of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Auxiliary viscosity improvers (also sometimes referred to as viscosity index improvers) may be included in the compositions of this invention. Viscosity improvers are usually polymers, including polyisobutenes, polymethacrylic acid esters, diene polymers, polyalkyl styrenes, alkenylarene-conjugated diene copolymers and polyolefins. Multifunctional viscosity improvers, other than those of the present invention, which also have dispersant and/or antioxidancy properties are known and may optionally be used in addition to the products of this invention. Such products are described in numerous publications including those mentioned in the Background of the Invention. Each of these publications is hereby expressly incorporated by reference.

Pour point depressants are a particularly useful type of additive often included in the lubricating oils described herein. See for example, page 8 of 'Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent number 1,306,529 and in many U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl other and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight usually ranging from about 0.01% to about 20% by weight, more often from about 1% to about 12% by weight. In most instances, they each contribute from about 0.1% to about 10% by weight.

The compositions of the present invention are present in minor amounts, often amounts ranging from about 1% to about 29% by weight, more often from about 3% to about 10% by weight, even more often from about 5% to about 8% by weight.

The various additives described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about 0.1 to about 80% by weight of the compositions of this invention and may contain, in addition, one or more other additives known in the art or described hereinabove. Concentrations such as 15%, 20%, 30% or 50% or higher may be employed.

The lubricating compositions of this invention are illustrated by the examples in the following Tables. The lubricating compositions are prepared by combining the specified ingredients, individually or from concentrates, in the indicated amounts and oil of lubricating viscosity to make the total 100 parts by weight. The amounts shown are indicated as parts by weight or parts by volume. Unless indicated otherwise, where components are indicated as parts by weight, they are amounts of chemical present on an oil-free basis. Thus, for example, an additive comprising 50% oil used at 10% by weight in a blend, provides 5% by weight of chemical. Where oil or other diluent content is given, it is for information purposes only and does not indicate that the amount shown in the table includes oil. Amounts of products of examples of this invention include oil content, if any.

Where percentages of components are on a volume basis, the examples indicate the amounts of diluent (if any) present in the component as percent by weight diluent.

These examples are presented for illustrative purposes only, and are not intended to limit the scope of this invention.

TABLE I

| | LUBRICANTS | | | | | |
|---|---|---|---|---|---|---|
| Components/Example | I (a) | II (a) | III (a) | IV (a) | V (a) | VI (a) |
| Base Oil | Cit Con | Ashland | Ashland | Ashland | Ashland | Exxon |
| Grade | 10W-30 | 10W-30 | 10W-30 | 5W-30 | 10W-30 | — |
| Product: Example I-B | 8 | 7.5 | 7.0 | | 7.0 | |
| Product: Example 5 | | | | 8 | | 12.25 |
| Polyisobutenyl succinic anhydride - ethylene polyamine reaction product | 1.69 | 1.69 | 1.24 | 1.0 | 1.63 | 1.88 |

TABLE I-continued

| Components/Example | LUBRICANTS I (a) | II (a) | III (a) | IV (a) | V (a) | VI (a) |
|---|---|---|---|---|---|---|
| (3% oil, 1.1% N) | | | | | | |
| Zn mixed primary/dialkyl dithiophosphate (11% oil) | | | 0.48 | | 0.48 | 0.84 |
| Zn mixed primary/secondary dialkyl dithiophosphate (12% oil) | | | | | | 0.67 |
| Zn secondary dialkyl dithiophosphate (10% oil) | 0.88 | 0.88 | 0.48 | 1.0 | 0.48 | 0.30 |
| Cu secondary dialkyl dithiophosphate (10% oil) | 0.08 | 0.08 | | | | |
| Ca overbased petroleum sulfonate, MR 12 (52% oil) | | | | | 0.26 | |
| Ca overbased petroleum sulfonate MR 12 (48% oil) | 0.21 | 0.21 | 0.28 | 0.28 | | 0.17 |
| Neutral Ca petroleum sulfonate (63% oil) | | | | | | 0.17 |
| Mg overbased alkyl benzene sulfonate, MR 14.7 (32% oil) | 0.31 | 0.31 | 0.29 | 0.29 | 0.29 | 0.18 |
| Na overbased alkyl benzene sulfonate, MR 20 (18% oil) | 0.41 | 0.41 | 0.3 | 0.3 | 0.3 | 0.22 |
| Sulfurized alkyl phenol (42% oil) | 0.4 | 0.4 | | | | |
| Styrene-maleate copolymer (60% oil) | 0.08 | 0.08 | 0.08 | 0.08 | | |
| Fatty amide | | | 0.1 | 0.1 | 0.1 | |
| Nonylphenoxy polyethoxy-ethanol | | | | | | |
| Silicone antifoam agent | 130 ppm | 100 ppm | 100 ppm | 65 ppm | 60 ppm | 77 ppm |
| Glycerol monooleate | 0.2 | 0.2 | | | | |
| Sulfurized Diels-Alder adduct | | | 0.2 | 0.2 | 0.2 | |
| Alkylated diphenyl amine (16% oil) | | | 0.09 | 0.09 | 0.1 | |
| Polymethacrylate pour point depressant (60% oil) | | | | | | 0.1 |

(a) Percent by weight (oil free unless otherwise indicated)

The following examples are lubricating oil compositions prepared as in Example VI replacing 12.25% by weight of the product of Example 5 with the listed amounts of the products shown:

| Example | Product of Example | Amount (% by weight) |
|---|---|---|
| VII | 5 | 9 |
| VIII | 2-B | 8 |
| IX | 2-B | 9 |
| X | 5 | 14.7 |
| XI | 2-B | 12.25 |
| XII | 2-B | 14.7 |
| XIII | 3 | 15.9 |
| XIV | 3 | 13.3 |
| XV | 10 | 12.25 |
| XVI | 10 | 14.7 |
| XVII | 13 | 11.8 |
| XVIII | 13 | 14.2 |
| XIX | 4 | 12.25 |
| XX | 4 | 14.7 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A dispersant-viscosity improver for lubricating oil composition comprising the reaction product of reactants comprising (a) an oil soluble, substantially hydrogenated, vinyl substituted aromatic-aliphatic conjugated diene block copolymer said copolymer having a number average molecular weight ranging from about 30,000 to about 300,000, grafted with an ethylenically unsaturated carboxylic acid or functional derivative thereof;

(b-1) at least one polyester containing at least one condensable hydroxyl group; and (b-2) at least one polyamine having at least one condensable primary or secondary amino group.

2. The dispersant-viscosity improver of claim 1 wherein the reactants further comprise (c) at least one hydrocarbyl substituted carboxylic acid or anhydride.

3. The dispersant-viscosity improver of claim 1 wherein the polyamine (b-2) is the reaction product of a polyamine and at least one hydrocarbyl substituted carboxylic acid or anhydride wherein the reaction product contains at least one condensable N—H group.

4. The dispersant-viscosity improver of claim 3 wherein the reaction product of a polyamine and carboxylic acid or anhydride (b-2) is borated.

5. The dispersant-viscosity improver of claim 2 wherein (c) is first reacted with at least one of (b-1) and (b-2).

6. The dispersant-viscosity improver of claim 2 wherein (c) is reacted with the reaction product of (a), (b-1) and (b-2).

7. The dispersant-viscosity improver of claim 2 wherein (c) is reacted simultaneously with (a), (b-1) and (b-2).

8. The dispersant-viscosity improver of claim 1 wherein (b-1) the polyester is first reacted with (a) the grafted copolymer before reaction with (b-2) the polyamine.

9. The dispersant-viscosity improver of claim 1 wherein the polyamine (b-2) is first reacted with (a) the grafted vinyl substituted aromatic-aliphatic conjugated diene copolymer before reaction with (b-1) the polyester.

10. The dispersant-viscosity improver of claim 1 wherein the block copolymer is a substantially hydrogenated linear normal block copolymer or a random block copolymer, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from 20% to about 70% by weight and the total amount of said diene blocks in said block copolymer being in the range of from about 30% to about 80% by weight.

11. The dispersant-viscosity improver of claim 1 wherein the vinyl substituted aromatic is styrene.

12. The dispersant-viscosity improver of claim 1 wherein the diene is isoprene or butadiene.

13. The dispersant-viscosity improver of claim 1 wherein the polyester (b-1) is the reaction product of at least one hydrocarbyl substituted polycarboxylic acid or anhydride with at least one polyol.

14. The dispersant-viscosity improver of claim 2 wherein the hydrocarbyl substituent of the hydrocarbyl substituted carboxylic acid or anhydride (c) contains at least about 8 carbon atoms.

15. The dispersant-viscosity improver of claim 14 wherein the hydrocarbyl substituent is an aliphatic group containing at least about 30 carbon atoms.

16. The dispersant-viscosity improver of claim 2 wherein (c) comprises a mixture of hydrocarbyl substituted carboxylic acids or anhydrides wherein the mixture comprises aliphatic substituted carboxylic acids or anhydrides containing from about 12 to about 24 carbon atoms in the aliphatic substituent and aliphatic substituted carboxylic acids or anhydrides having at least about 40 carbon atoms in the aliphatic substituent.

17. The dispersant-viscosity improver of claim 1 wherein the polyamine (b-2) is at least one member of the group consisting of alkylene polyamines having at least one N—H group, polyamine bottoms having at least one N—H group, polyoxyalkylene polyamines having at least one N—H group, alkanol amines having at least one N—H group, and derivatives of hydrocarbon-based monocarboxylic or hydrocarbon-substituted succinic acids with polyamines, said derivative containing at least one N—H group, or mixtures thereof.

18. The dispersant-viscosity improver of claim 17 wherein the polyamine (b-2) comprises at least one derivative of said hydrocarbon-substituted succinic acid with polyamines wherein the hydrocarbon substituent contains from about 16 to about 100 aliphatic carbon atoms.

19. The dispersant-viscosity improver of claim 1 wherein (b-2) comprises at least one alkylene polyamine having the formula $$H-\underset{\underset{R}{|}}{N}-(\text{alkylene-NR})_n-R$$

wherein n is a number from 1 to about 10, each R is independently hydrogen, a hydrocarbyl group having from 1 to about 30 carbon atoms or groups of the formula -alkylene-$NR_2$, said alkylene group containing from 2 to about 10 carbon atoms.

20. The dispersant-viscosity improver of claim 1 wherein (b-1) is a polyester of hydrocarbon-substituted monocarboxylic and dicarboxylic acids or mixtures thereof, said hydrocarbon substituent containing from 5 to about 500 carbon atoms.

21. The dispersant-viscosity improver of claim 1 wherein the polyester is derived from an aliphatic hydrocarbon substituted succinic acid containing from about 16 to about 100 carbon atoms in the aliphatic hydrocarbon substituent.

22. The dispersant-viscosity improver of claim 21 wherein the polyester is derived :from at least one polyol selected from the group consisting of pentaerythritol, 2-ethyl-2-hydroxymethyl-1,3-propanediol, sorbitol, glycerol, a polyetherpolyol, 2-ethyl-2-amino-1,3-propanediol and tris-hydroxymethyl aminomethane.

23. The dispersant-viscosity improver of claim 1 wherein the ethylenically unsaturated carboxylic acid or functional derivative thereof, is an alpha, beta-unsaturated carboxylic acid or functional derivative thereof containing from 2 to about 20 carbon atoms exclusive of carbonyl carbons.

24. The dispersant-viscosity improver of claim 1 wherein the carboxylic acid or functional derivative thereof, comprises at least one member of the group consisting of maleic acid, maleic anhydride, fumaric acid, itaconic acid and itaconic anhydride and esters of the acids.

25. An oil soluble or dispersible composition comprising the reaction product of reactants comprising (a) an oil soluble, substantially hydrogenated block copolymer of a vinyl substituted aromatic with a aliphatic conjugated diene, said copolymer having a number average molecular weight ranging from about 30,000 to about 300,000, grafted with an alpha,beta-ethylenically unsaturated carboxylic acid or functional derivative thereof;

(b-1) a polyisobutenyl substituted succinic polyester which polyester contains an average of at least one free hydroxyl group per mole of succinic groups; and (b-2) an alkylene polyamine having the formula $$H_2N\text{-(alkylene-NR)}_n\text{-H}$$

wherein n is a number from 1 to about 10, each R is independently hydrogen, a hydrocarbyl group having from 1 to about 30 carbon atoms or a group of the formula $$\left(\text{alkylene}-\overset{\overset{R}{|}}{N}\right)_x H$$

wherein each x is independently 0 or a number from 1 to about 5, and said alkylene group contains from 2 to about 10 carbon atoms.

26. The composition of claim 25 wherein the reactants further comprise (c) at least one aliphatic hydrocarbon substituted carboxylic acid or anhydride.

27. The composition of claim 26 wherein the carboxylic acid or anhydride is a monocarboxylic acid or anhydride.

28. The composition of claim 26 wherein the carboxylic acid or anhydride is a polycarboxylic acid or anhydride.

29. The composition of claim 25 wherein the copolymer is a normal block copolymer having a total of two or three polymer blocks or a random block copolymer, wherein the number average molecular weight of said copolymer is from about 30,000 to about 300,000, and wherein in said copolymer the total amount of said conjugated diene is from about 40% to about 60% by weight and the total amount of said vinyl substituted aromatic is from about 40% to about 60% by weight.

30. The composition of claim 25 wherein the polyisobutenyl group on (b-1) the polyester has from about 30 to about 150 carbon atoms, and said polyester is a pentaerythritol polyester.

31. The composition of claim 25 wherein the amine (b-2) comprises ethylene polyamine bottoms.

32. The composition of claim 25 wherein each R in the amine (b-2) is hydrogen.

33. The composition of claim 25 wherein grafting of the vinyl substituted aromatic-aliphatic conjugated diene copolymer is conducted at 100° C. to about 200° C. in the presence of a free radical initiator.

34. The composition of claim 25 wherein the polyester (b-1) has been post treated with about 0.2 to about 5 equivalents of an ethylene polyamine per mole of succinic groups in the polyester.

35. An additive concentrate comprising an inert normally liquid organic diluent and from about 5 to about 40 percent by weight of the dispersant-viscosity improver of claim 1.

36. An additive concentrate comprising an inert normally liquid organic diluent and from about 5 to about 40 percent by weight of the composition of claim 25.

37. The additive concentrate of claim 36 further comprising from about 1% to about 5% by weight of at least one pour point depressant selected from the group consisting of polymethacrylates, alkylated naphthalenes and maleate/vinyl acetate copolymers.

38. The additive concentrate of claim 37 further comprising from about 1% to about 5% by weight of at least one pour point depressant selected from the group consisting of polymethacrylates, alkylated naphthalenes and maleate/vinyl acetate copolymers.

39. A lubricating composition comprising a major amount of an oil of lubricating viscosity and a minor amount of the dispersant-viscosity improver of claim 1.

40. A lubricating composition comprising a major amount of an oil of lubricating viscosity and a minor amount of the composition of claim 25.

41. A lubricating composition comprising a major amount of an oil of lubricating viscosity and a minor amount of the additive concentrate of claim 35.

42. A lubricating composition comprising a major amount of an oil of lubricating viscosity and a minor amount of the additive concentrate of claim 36.

43. The lubricating composition of claim 39 wherein the oil of lubricating viscosity is a synthetic oil.

44. The lubricating composition of claim 39 wherein the oil of lubricating viscosity is a mineral oil.

45. The lubricating composition of claim 43 wherein the synthetic oil is a polyalphaolefin oil.

46. The lubricating composition of claim 44 wherein the mineral oil is a hydrotreated naphthenic oil.

* * * * *